United States Patent [19]

Formanek et al.

[11] Patent Number: 4,490,168

[45] Date of Patent: Dec. 25, 1984

[54] PROCESS OF MAKING STEEL BY MELTING SPONGE IRON IN AN ELECTRIC ARC FURNACE

[75] Inventors: Lothar Formanek, Frankfurt am Main; Martin Hirsch, Friedrichsdorf; Wolfram Schnabel, Idstein; Harry Serbent, Hanau am Main; Klaus-Dietrich Fritzsche, Oberhausen; Heribert Koenig; Detmar Arlt, both of Duisburg, all of Fed. Rep. of Germany

[73] Assignees: Metallgesellschaft AG, Frankfurt am Main; Mannesmann AG, Dusseldorf, both of Fed. Rep. of Germany

[21] Appl. No.: 569,710

[22] Filed: Jan. 11, 1984

[30] Foreign Application Priority Data

Jan. 13, 1983 [DE] Fed. Rep. of Germany ..... 3300867

[51] Int. Cl.[3] ..... C21B 1/06

[52] U.S. Cl. ..... 75/10 R; 75/11; 75/12; 75/44 S

[58] Field of Search ..... 75/10–12, 75/44 S, 26, 46

[56] References Cited

U.S. PATENT DOCUMENTS

| | | | |
|---|---|---|---|
| 2,894,831 | 7/1959 | Old | 75/26 |
| 3,206,299 | 9/1965 | Senior | 75/11 |
| 3,224,871 | 12/1965 | Collin | 75/11 |
| 3,505,060 | 4/1970 | Heitmann | 75/11 |
| 3,948,641 | 4/1976 | Langhammer | 75/11 |

*Primary Examiner*—Peter D. Rosenberg

*Attorney, Agent, or Firm*—Sprung Horn Kramer & Woods

[57] ABSTRACT

Sponge iron produced by direct reduction is melted in an electric arc furnace, in which a pool of liquid metal is maintained. To ensure that liquid carbon-containing iron for forming the pool is available in adequate quantities and that the process can be carried out with the highest possible economy, the sponge iron is reacted in an electric arc furnace on a bath of liquid carbon-containing iron (hot metal), which has been produced from sponge iron or from partly reduced ore in an electric reducing furnace, and in dependence on the electric load changes which are due to the operation of the electric arc furnace the operation of the electric reducing furnace is so controlled that a virtually constant load on the electric power supply system is maintained.

25 Claims, 2 Drawing Figures

PROCESS OF MAKING STEEL BY MELTING SPONGE IRON IN AN ELECTRIC ARC FURNACE

BACKGROUND OF THE INVENTION

1. Field of the Invention

This invention relates to a process of making steel by melting sponge iron in an electric arc furnace, which sponge iron is produced by direct reduction.

2. Discussion of Prior Art

It is known that difficulties will be encountered when an electric arc furnace is charged only with sponge iron (direct reduced iron). These difficulties are due to the low density and the low conductivity of the sponge iron. Nevertheless, it is desired to use mainly sponge iron in an electric arc furnace. In that case it is advantageous to maintain in the furnace a pool of carbon-containing liquid iron (hot metal), to charge the sponge iron onto said pool and to supply most of the additional energy via said pool (hot metal process).

But even in that hot metal process the electric arc furnace must be completely emptied after two or three charges so that the lining can be repaired. As a result, the furnace cannot be continuously operated in that hot metal process since a new pool must be formed whenever the furnace has been emptied. For this reason the advantages which are inherent in that process cannot be fully utilized unless molten iron is available from another source, preferably from a blast furnace. But this option is very unlikely in a plant for processing sponge iron.

Additionally, the energy consumption of an electric arc furnace exhibits large fluctuations owing to the characteristic mode of operation and furthermore owing to the discontinuous mode of operation of the electric arc furnace. These fluctuations refer to the rate at which energy is consumed and to the total quantity of energy which is consumed. The electric power supply system powering an electric arc furnace must be so powerfull that the reaction which is due to the furnace operation does not exceed the permissible limits.

SUMMARY OF THE INVENTION

It is an object of the invention to provide a process which permits an electric arc furnace to be operated in an advantageous manner with a hot metal pool in that an availability of hot metal in adequate quantities is ensured and the process is carried out with substantial economies.

This object is accomplished according to the invention in that the sponge iron is reacted in an electric arc furnace on a pool of molten carbon-containing liquid iron, the carbon-containing liquid iron (hot metal) is produced also from sponge iron or from partly reduced ore in an electric reducing furnace, and in dependence on the fluctuations of the electrical load which are due to the operation of the electric arc furnace, the operation of said electric reducing furnace is so controlled that the load on the electric power supply system is substantially stabilized.

By the combination of a process step for producing the carbon-containing liquid iron required to form the hot metal pool in the electric arc furnace, which iron is preferable produced from the precursor material used also in the electric arc furnace, and of a step in which the sponge iron is melted in the electric arc furnace, the process according to the invention produces a total result which exceeds the sum of the results of the individual steps of the process because the melting operation is improved and the load on the electric power supply system is stablilized in a surprisingly simple manner.

The term "electric arc furnace" describes a furnace which is directly heated by electric arcs struck between the electodes, on the one hand, and the metallic charge or the steel bath, on the other hand (direct arc furnace). The term "electric reducing furnace" describes a furnace in which the electrodes are immersed into an open slag bath or in an upright column of burden and in which energy is consumed mainly by resistance heating (submerged arc furnace). The latter furnaces are highly suitable for reducing operations, also with an open slag bath, and from sponge iron and added carbon sources produce carbon-containing liquid iron, which is used in the electric arc furnace to form a hot metal pool therein. Electric reducing furnaces can be operated with a variable power input.

According to a preferred further feature of the invention, the waste heat which becomes available in the exhaust gas as a result of the direct reduction and the energy carriers which are made available by and/or for the direct reduction are used to produce electric power to be supplied to the system comprising the electric reducing furnace and the electric arc furnace. Energy carriers may consist of surplus carbonaceous solids or combustible gases which are made available by the direct reduction, or of surplus combustible gases or carbonaceous solids which are made available by the production of the reducing medium for the direct reduction.

According to another preferred feature, the quantity and analysis of the carbon-containing liquid iron charged to the electric arc furnace to form the hot metal pool therein are so selected that an overall carbon balance is obtained during the charging of sponge iron to the electric arc furnace, and the active power input to the electric arc furnace is so controlled that the thermal equilibrium required for the melting of sponge iron is maintained in the electric arc furnace. There is an equilibrium when there is no overheating and no freezing.

According to another preferred feature, sponge iron having a low degree of metallization e.g. below 80 to 90% is used mainly in the electric reducing furnace to produce carbon-containing liquid iron (hot metal).

According to a preferred further feature, surplus carbonaceous solids are separated from the solids produced by a direct reduction process with solid carbonaceous reducing agents, at least part of said surplus carbonaceous solids is burnt in a combustion furnace supplied with oxygen-containing gases, the hot flue gases produced by said combustion and the exhaust gas from the direct reduction stage are used to generate electric power at a controlled rate, which is at least as high as the sum from the highest power demand of the electric arc furnace plus the lowest power demand of the electric reduction furnace, and power which is not required by the electric arc furnace at a given time is consumed in the electric reducing furnace. The surplus carbonaceous solids are entirely burnt if they are of a quality which cannot be used in the electric reducing furnace or if the addition of said solids to the electric reducing furnace is not required. The carbonaceous solids have a high quality if they have relatively low ash (e.g. below their carbon content) and sulfur contents (e.g. below 1%) and a basic ash. The separated surplus carbonaceous solids can also be separated into a high-quality fraction, which is supplied to the electric reducing furnace, and a low-quality fraction, which is burnt. The lowest power demand of the electric reducing furnace is the power required to hold the electric reducing furnace at the holding temperature.

The sensible heat of the hot flue gases and of the exhaust gases from the direct reduction stage are used to generate steam, which by means of steam turbines drives a generator for producing electric power. The hot flue gases and the exhaust gases from the direct reduction stage are desirably supplied to separate steam generators and the steam streams are supplied to separate turbines. In that case the turbine supplied with the steam generated by means of the exhaust gas from the direct reduction stage can always be operated in its optimum range and the utilization and control can be improved. The electric power which is generated must correspond to the sum of the highest power demand of the electric arc furnace and the lowest power demand of the electric reduction furnace. Additional electric power can be produced for other uses in the same plant but that surplus power is not taken into account in the control of the power distribution. The electric power is distributed in such a manner that the power demand of the electric arc furnace will always be met. When its power demand is high, less electric power will be supplied to the electric reducing furnace, to which more electric power will be supplied when the electric arc furnace is shut down.

The sponge iron is distributed in such a manner that carbon-containing liquid iron (hot metal) in the quantity required for making steel in the electric arc furnace is produced in the electric reducing furnace.

The sponge iron may be hot-sieved and may then be charged to the melting furnaces at an elevated temperature. The surplus carbonaceous solids can be burnt in fluidized bed furnaces or in dust-burning furnaces, such as cyclone furnaces.

According to a preferred further feature, the exhaust gas from the direct reduction stage is afterburnt before it is used to generate electric power. In that case the latent heat content of the exhaust gas will also be utilized and an uncontrolled combustion will be avoided, particularly if the solids have substantial contents of gaseous and solid combustible constituents.

According to a preferred feature, additional combustible material is supplied to the combustion furnace. In that case a thermally self-sufficient operation can be carried out even if the exhaust gas and the hot flue gases produced by the combustion of the surplus carbonaceous solids have an inadequate heat content.

According to a preferred feature, the combustion furnace comprises a circulating fluidized bed. In a circulating fluidized bed there is no sudden change in suspension density between a dense phase and an overlying dust space but the solids concentration decreases gradually from bottom to top.

The definition of the operating conditions by means of the Froude and Archimedes numbers results in the ranges:

$$0.1 \leqq \tfrac{3}{4} \cdot Fr^2 \cdot \frac{\rho g}{\rho k - \rho g} \leqq 10$$

and $$0.01 \leqq Ar \leqq 100$$

wherein $$Ar = \frac{d_k^3 \cdot g(\rho k - \rho g)}{\rho g \cdot \nu^2} \text{ and } Fr^2 = \frac{u^2}{g \cdot d_k}$$

In the above formulas u = the relative gas velocity in m/sec.

Ar = the Archimedes number

Fr = the Froude number $\rho g$ = the density of the gas in kg/m$^3$ $\rho k$ = the density of the solid particle in kg/m$^3$ $d_k$ = the diameter of the spherical particle in m $\nu$ = the kinematic viscosity in m$^2$/sec.

g = the acceleration due to gravity in m/sec$^2$.

Such processes, which are particularly suitable for burning surplus carbonaceous solids, have been described in German patent publication No. 25 39 546, U.S. Pat. No. 41 65 717, Laid-open German application No. 26 24 302 and U.S. Pat. No. 4,111,156.

According to a preferred further feature, a combustible gas is produced in a separate step by a devolatilization and/or partial gasification of carbonaceous solids and is used to generate electric power, and the devolatilized carbonaceous solids are charged to the direct reduction stage and/or the electric reducing furnace and/or the combustion furnace. By the charging of devolatilized carbonaceous solids the rate at which exhaust gas is produced by the direct reduction is decreased and the through-put of the direct reduction stage is increased. As the exhaust gases from the direct reduction stage contains less combustible gaseous constituents, less electric power is produced by the exhaust gas so that the base load, which cannot be controlled, is lower and the electric power generated by the combustion can be controlled in a larger range. Part or all of the devolatilized carbonaceous solids may be supplied to the combustion furnace so that the rate at which said solids are charged to the direct reduction stage can also be varied. The generation of electric power by the combustible gases is highly flexible. Part of the combustible gas may be used in the same plant for other purposes.

According to a preferred feature, the devolatilization and/or partial gasification is effected in a circulating fluidized bed. The circulating fluidized bed is highly suitable and can be operated in a flexible manner. A particularly suitable process is described in European patent application No. 62 363. If the devolatilized carbonaceous solids from the gasifying stage are charged to the direct reduction stage, no part of said solids will be charged to the combustion stage.

According to a further preferred feature, combustible gas is stored in a gas holder and is taken therefrom for the generation of electric power in case of need. That storage results in a high flexibility and provides reserves particularly for running up and shutting down the plant.

According to a further preferred feature, the combustible gas is used in a gas turbine for the generation of electric power. The power which is produced can quickly be varied if a gas turbine is employed.

According to a further preferred feature, caking coal is supplied to the circulating fluidized bed. In that case such coal can be used without an additional expenditure whereas it cannot be charged directly to the direct reduction stage.

According to a further preferred feature, surplus carbonaceous solids which have been separated from the solids produced by the direct reduction are charged to the electric reducing furnace, additional energy carriers are burnt in a combustion furnace supplied with oxygen-containing gases, the hot flue gases and the exhaust gas from the direct reduction stage are used to generate electric power which is at least as high as the sum of the highest power demand of the electric arc furnace and the lowest power demand of the electric reducing furnace, and power which is not required in the electric arc furnace at a given time is consumed in the electric reducing furnace. All surplus carbonaceous solids which have been separated are charged to the electric reducing furnace if those carbonaceous solids are of high quality and are required in the electric reducing furnace.

According to a preferred further feature, the direct reduction is carried out in a rotary kiln. In most cases, the coals used as reducing agents such as brown or subbituminous coals, have a relatively high content of volatile constituents and a high reactivity.

BRIEF DESCRIPTION OF DRAWINGS

The invention will be explained more fully with reference to the drawings in which.

DESCRIPTION OF SPECIFIC EMBODIMENT

Figure 1:
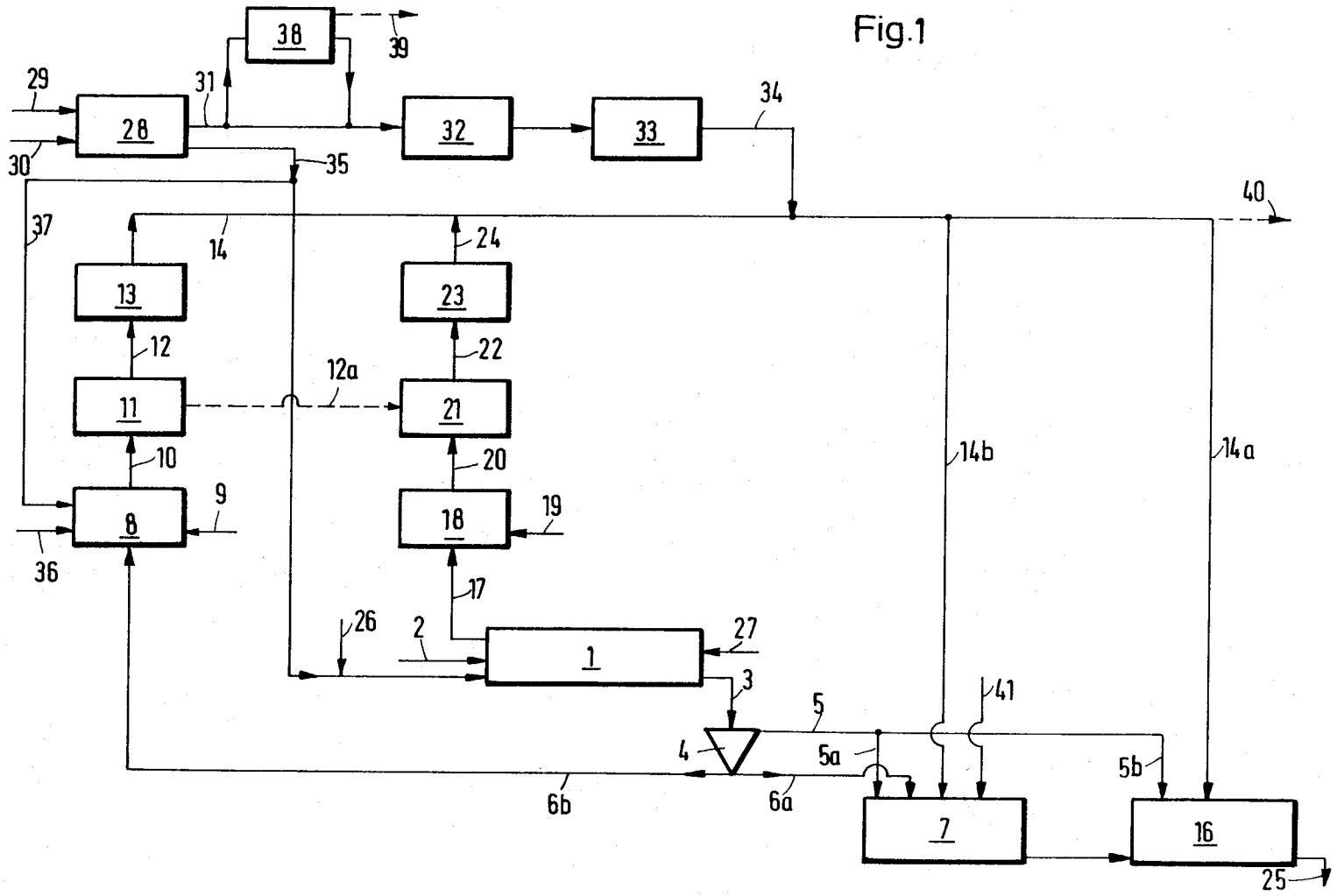
FIG. 1 is a flow diagram showing one mode for carrying out the invention.

As is shown in FIG. 1, iron ore 2 is charged to a rotary kiln 1 and reduced therein to sponge iron. In a separating stage 4, the solids 3 discharged from the rotary kiln 1 are separated into sponge iron 5 and surplus carbonaceous solids. One part 6*a* of said carbonaceous solids is supplied to the electric reducing furnace 7 and the other part 6*b* is supplied to and burnt in the circulating fluidized bed 8, which is supplied with air 9. The hot flue gas 10 is supplied to the steam generator 11. The steam 12 is used to drive an electric generator 13. The electric power which is generated is supplied in line 14 to the electric reducing furnace 7 and in line 14*a* to the electric arc furnace 16.

The exhaust gas 17 from the rotary kiln 1 is afterburnt in an afterburning chamber 18, which is supplied with air 19. The hot gas 20 is supplied to the steam generator 21. The steam 22 is used to drive an electric generator 23. The electric power which is generated is fed in line 24 to line 14.

One part 5*a* of the sponge iron 5 is charged to the electric reducing furnace 7 and another part 5*b* is charged to the electric arc furnace 16. The hot metal produced in the electric reducing furnace is charged to the electric arc furnace 16, from which steel 25 is tapped. The power required by the electric arc furnace 16 at any time is always supplied via line 14*a*. The remaining electric power is supplied via line 14*b* to the electric reducing furnace 7.

The rotary kiln 1 may be operated with coal which has a high content of volatile constituents. That coal is charged into the charging end via 26 and is partly blown into the discharge end by means of the blowing apparatus 27. In that case the exhaust gas 17 has a higher content of combustible gaseous constituents and a correspondingly high electric power is generated in 24.

Additional coal 29 may be devolatilized and partly burnt in the circulating fluidized bed 28 supplied with oxygen-containing gases 30. The combustible gas 31 is burnt in a gas turbine 32, which drives an electric generator 33. The electric power which is generated is supplied via line 34 to line 14. The devolatilized carbonaceous solids are charged from the fluidized bed 28 via duct 35 to the rotary kiln 1. In that case, no coal having a high content of volatile constituents is charged to the rotary kiln and the exhaust gas 17 has only a low content of combustible gaseous constituents. A correspondingly lower electric power is produced in 24.

A higher electric power can be generated if coal 36 is supplied to the fluidized bed. Part of the devolatilized carbonaceous solids removed from the fluidized bed 28 may be supplied via duct 37 to the fluidized bed 8.

Surplus electric power generated can be supplied via line 40 to other consumers in the same plant.

Combustible gas is stored in the gas holder 38 and is taken from it when needed. Combustible gas for the plant can be taken through duct 39 at a rate which has been allowed for in the production of gas.

Ore and admixtures can be charged to the electric reducing furnace 7 via duct 41.

During the operation of the electric arc furnace, carbon-containing liquid iron produced in the electric reducing furnace is supplied to the electric arc furnace at such a controlled rate and with such a controlled analysis, mainly as regards its carbon content, that an overall carbon balance is achieved as the sponge iron is charged. When sponge iron has been produced which has been metallized to a lower degree, e.g., of only 85% rather than 92%, for instance, owing to an error in the production of sponge iron, such sponge iron can be processed too but the insufficiently metallized sponge iron must be charged only to the electric reducing furnace. It is apparent that sponge iron having different degrees of metallization can be used in the process.

The steam produced in the steam generator 11 may alternatively be supplied to the electric generator 23 through line 12.

Figure 2:
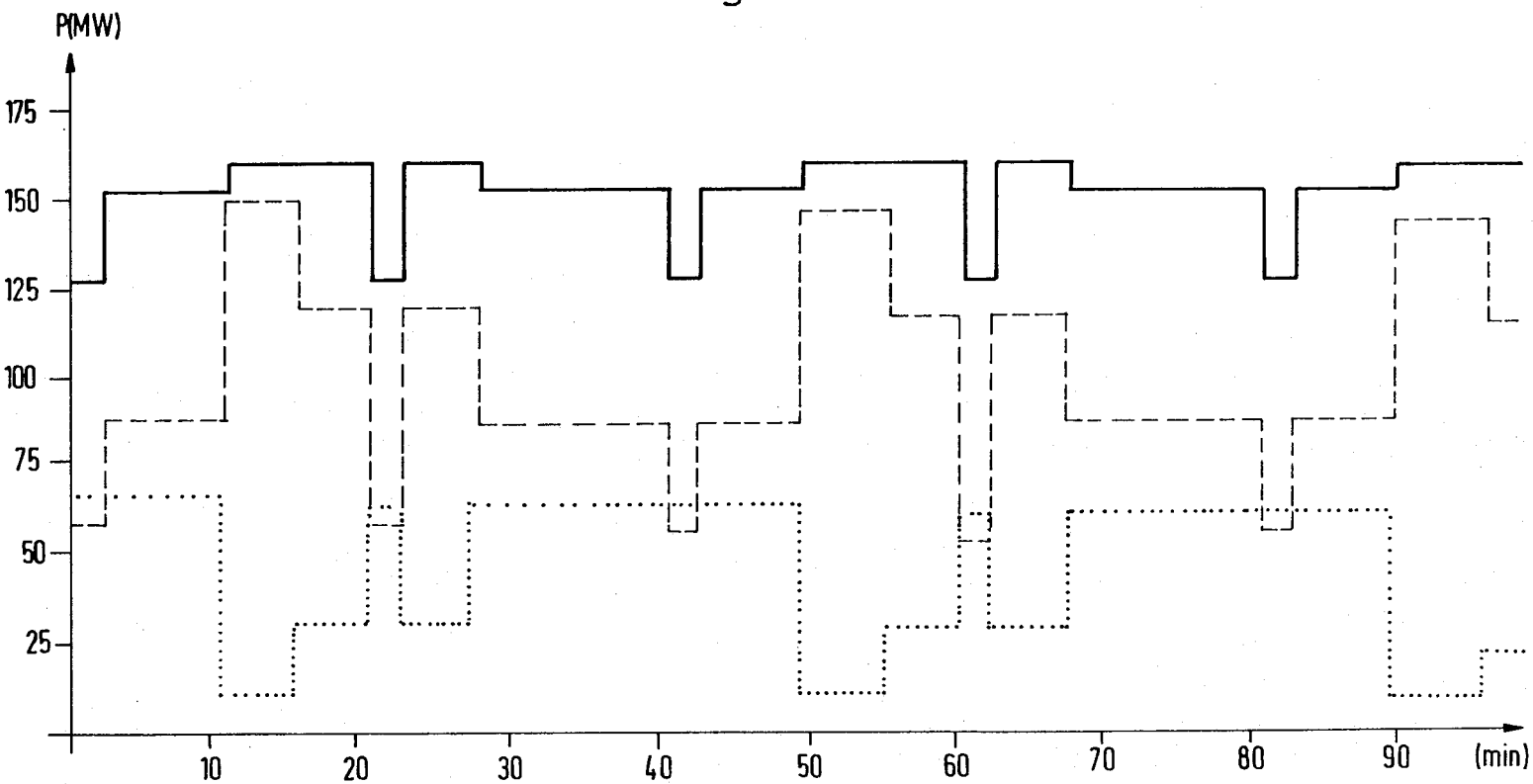
FIG. 2 is a load graph for three electric arc furnaces and two electric reducing furnaces operated in a combined system.

FIG. 2 is a typical load graph for three electric arc furnaces and two electric reducing furnaces operating in a combined system. The time in minutes is plotted on the x-axis and the active power in megawatts is plotted on the y-axis. The dotted line represents the change of the total active power input of the electric arc furnace, and the solid line represents the change of the total active power input of all melting furnaces. Typicle cycles of operation are indicated by the graph. It is particularly apparent that the total active power input of all melting furnaces is comparatively constant in spite of the large variations of the power inputs of the individual electric arc furnaces.

The advantages afforded by the invention reside in that the entire melting process can be carried out regardless of the capability of the public power supply system which is available, steel is made with a minimum energy requirement per ton of steel, the waste heat from the direct reduction stage for producing the sponge iron is utilized in an optimum manner, and the surplus carbonaceous solids separated from the solids produced by the direct reduction and any coal which may be added can be burnt in an ecologically satisfactory manner avoiding $SO_2$-emissions by an addition of limestone so that $CaSO_4$-containing residue is obtained, which can be dumped.

What is claimed is:

1. A process for making steel which comprises:

(a) directly reducing iron oxide containing ore;

(b) feeding at least a portion of the product of step (a) to an electric reducing furnace to form a carbon-containing molten iron;

(c) feeding said carbon-containing molten iron from step (b) to an electric arc furnace and forming a pool in said electric arc furnace;

(d) introducing sponge iron produced in step (a) into said pool of molten iron and forming steel from sponge iron and said molten iron; and (e) controlling the operations of said electric reducing furnace in dependence upon the amount of electric power consumed by said electric arc furnace such that the total amount of electric energy consumed by said electric arc furnace and said electric reducing furnace is virtually stabilized.

2. A process according to claim 1 which comprises withdrawing heated exhaust gases from step (a) and employing the same to produce electric power and supplying said electric power to said electric arc furnace or said electric reducing furnace.

3. A process according to claim 2, wherein said electric power is supplied to said electric arc furnace.

4. A process according to claim 1, wherein step (a) is performed by heating said iron oxide containing ore in the presence of solid carbonaceous solids.

5. A process according to claim 1, wherein

A. the amount of carbon containing molten iron charged to said electric arc furnace is so varied depending upon its carbon concentration so that the total carbon content of the combined amount of sponge iron and molten iron remains substantially constant; and B. the amount of electric power fed to the electric arc furnace is so controlled that the thermal equilibrium for melting the sponge iron in said electric arc furnace is maintained substantially constant.

6. A process according to claim 1, wherein sponge iron having a low metallization is used in said electric reducing furnace.

7. A process according to claim 2, wherein (a) is performed by heating said iron oxide containing ore in the presence of solid carbonaceous solids, surplus carbonaceous solids are separated from sponge iron produced by direct reduction, at least part of said surplus carbonaceous solids is burnt in a combustion furnace to which oxygen is supplied whereby to produce hot flue gases, said hot flue gases and the exhaust gas from said direct reduction stage are used to generate electric power at a controlled rate which is at least as high as the sum of the electric power required for the highest power demand of the electric reducing furnace and any power not required by said electric arc furnace is fed to said electric reducing furnace.

8. A process according to claim 7, wherein said exhaust gas from step (a) is afterburnt before it is used to generate electric power.

9. A process according to claim 7, wherein an additional combustible material is fed to said combustion furnace.

10. A process according to claim 7, wherein said combustion furnace comprises a circulating fluidized bed.

11. A process according to claim 7, wherein a combustible gas is produced in a separate step by devolatilization or partial gasification of carbonaceous solids and said combustible gas is used to generate electric power and the resultant devolatilized or partially gasified solids are fed to step (a) or to said electric reducing furnace or to said combustion furnace.

12. A process according to claim 11, wherein said carbonaceous solids are devolatilized.

13. A process according to claim 11, wherein said carbonaceous solids are partially gasified.

14. A process according to claim 11, wherein said devolitilized solids or partially gasified solids are fed to step (a).

15. A process according to claim 11, wherein said devolitilized solids or partially gasified solids are fed to said electric reducing furnace.

16. A process according to claim 11, wherein said devolitilized solids or partially gasified solids are fed to said combustion furnace.

17. A process according to claim 11, wherein said devolitilization or partial gasification is effected in a circulating fluidized bed.

18. A process according to claim 11, wherein said combustible gas is stored in a gas holder and is taken therefrom to generate electrical power.

19. A process according to claim 11, wherein said combustible gas is used in a gas turbine for electrical power generation.

20. A process according to claim 19, wherein caking coal is supplied to the circulating fluidized bed.

21. A process according to claim 4, wherein from step (a) there is withdrawn sponge iron and carbonaceous solids, said carbonaceous solids are, at least in part, separated from said sponge iron, said separated carbonaceous solids are fed to said electric reducing furnace, additional energy carrying material is burnt in a combustion furnace to which an oxygen containing gas is supplied whereby to produce a hot flue gas, said hot flue gas and exhaust gases from step (a) are used to generate electrical power which is produced in at least an amount equivalent to the sum of the highest power demand of said electric arc furnace and the lowest power demand of said electric reducing furnace and any electric power not required for said electric arc furnace is fed to said electric reducing furnace.

22. A process according to claim 21, wherein electric power is fed to said electric arc furnace before it is fed to said electric reducing furnace.

23. A process according to claim 1, wherein step (a) is performed in a rotary kiln.

24. A process according to claim 23, wherein step (a) is performed employing a solid carbonaceous reducing material, a portion of residual carbonaceous solids is fed to said electric reducing furnace and a portion of said carbonaceous solids is fed to a circulating fluidized bed burnt therein to produce a hot flue gas which is fed to a steam generator which is employed to make electricity.

25. A process according to claim 1, wherein electrical power not consumed by said electric arc furnace is fed to said electric reducing furnace.

* * * * *